US005372076A

United States Patent [19]

Solt

[11] Patent Number: 5,372,076

[45] Date of Patent: Dec. 13, 1994

[54] SIMULATED VIDEO CASSETTE TAPE REPOSITORY

[75] Inventor: Peter Solt, Chicago, Ill.

[73] Assignee: Adams Apple Distributing, L.P., Chicago, Ill.

[21] Appl. No.: 125,103

[22] Filed: Sep. 22, 1993

[51] Int. Cl.[5] ..... E05G 1/00; B65D 73/00

[52] U.S. Cl. ..... 109/22; 70/63; 206/457; 206/1.5; 109/54

[58] Field of Search ..... 109/22, 45, 49, 53, 109/54, 56, 57; 70/14, 57–58, 63, 456 R–459; 206/1.5, 444, 457, 387, 389, 391; 242/197; 360/132, 137

[56] References Cited

U.S. PATENT DOCUMENTS

| | | | |
|---|---|---|---|
| D. 128,625 | 8/1941 | Fischer | 70/457 |
| D. 204,795 | 5/1966 | Dickerson | D48/20 |
| D. 209,599 | 12/1967 | Craighead | D34/11 |
| D. 218,626 | 9/1970 | Bateman | D21/02 |
| 1,510,632 | 10/1924 | Nutry | 70/63 |
| 3,298,601 | 1/1967 | Brown | 232/4 |
| 3,582,169 | 6/1971 | Koenig | 70/63 |
| 3,717,112 | 2/1973 | Welty | 109/54 X |
| 3,785,184 | 1/1974 | Wirth | 70/63 |
| 3,862,555 | 1/1975 | Wirth | 70/63 |
| 4,011,940 | 3/1977 | Neal et al. | 206/1.5 |
| 4,040,204 | 8/1977 | Zucker | 46/2 |
| 4,083,314 | 4/1978 | Garvin | 109/54 X |
| 4,244,303 | 1/1981 | Kurasik | 109/54 X |
| 4,531,635 | 7/1985 | Cleveland | 206/457 |
| 4,542,848 | 9/1985 | Peters | 109/45 X |
| 4,716,745 | 1/1988 | Hehn | 70/58 |
| 5,066,079 | 11/1991 | Lawrence | 109/54 X |
| 5,069,645 | 12/1991 | Dworman et al. | 206/457 X |
| 5,074,417 | 12/1991 | Kenny | 206/457 X |
| 5,211,287 | 5/1993 | Weisburn et al. | 206/1.5 X |

*Primary Examiner*—Peter M. Cuomo
*Assistant Examiner*—Suzanne L. Dino
*Attorney, Agent, or Firm*—Laff, Whitesel, Conte & Saret

[57] ABSTRACT

A repository for storing small articles is constructed to resemble a common household object, such as a videotape cassette. The articles are placed in two containers mounted on the base of the repository, and the containers are sealed by a cover which is placed over them. The closed repository can be inserted into a sleeve which holds the base and the cover together. The sleeve has been marked with letters and designs to resemble the sleeve of a standard videotape cassette. The cover has been formed to resemble the top of a standard videotape cassette, but it also has a picture attached to it which depicts the inside of a videotape cassette and which thereby simulates a videotape cassette even more effectively. By simulating a common household object such as a video cassette, the repository is not likely to be discovered by a thief. The base includes apertures like those of a standard videotape cassette. The undersides of the containers are visible from outside the repository through two of these apertures in the base. These visible portions of the containers have been formed to resemble the sockets and sprockets of standard videotape spools normally visible through the bottomside of a videotape cassette and thus add to the effectiveness of the simulation.

8 Claims, 3 Drawing Sheets

SIMULATED VIDEO CASSETTE TAPE REPOSITORY

FIELD OF THE INVENTION

This invention relates to a repository for storing small articles, and more particularly to a repository formed by modifying a popular object or article of utility.

BACKGROUND OF THE INVENTION

The concept of a decorative object also serving as a repository for small articles is not new. In general, however, a significant and costly modification to the decorative object is required to allow it to function as a repository, such as that for the picture frame of U.S. Pat. No. 4,244,303. Other repositories are expressly designed and manufactured to resemble decorative objects, such as those of U.S. Pat. Nos. 3,298,601 and 4,040,204.

It would therefore be of great utility to create a repository resembling a household object without manufacturing a costly or complex repository structure.

SUMMARY OF THE INVENTION

Accordingly, it is an object of the present invention to provide a repository readily manufacturable from a common household object for storing and concealing small articles, thereby free of the aforementioned defects and disadvantages of the prior art.

In a preferred embodiment of the invention, a repository resembling a VHS videotape cassette housing is formed from a base with containers within its perimeter, and a cover which follows the contour of the base and seals the containers.

These and other features of the invention will be more fully understood by reference to the following drawings.

DETAILED DESCRIPTION OF THE INVENTION

During the course of this description, like reference numbers will be used to identify like elements throughout the various figures of the drawings.

Figure 1:
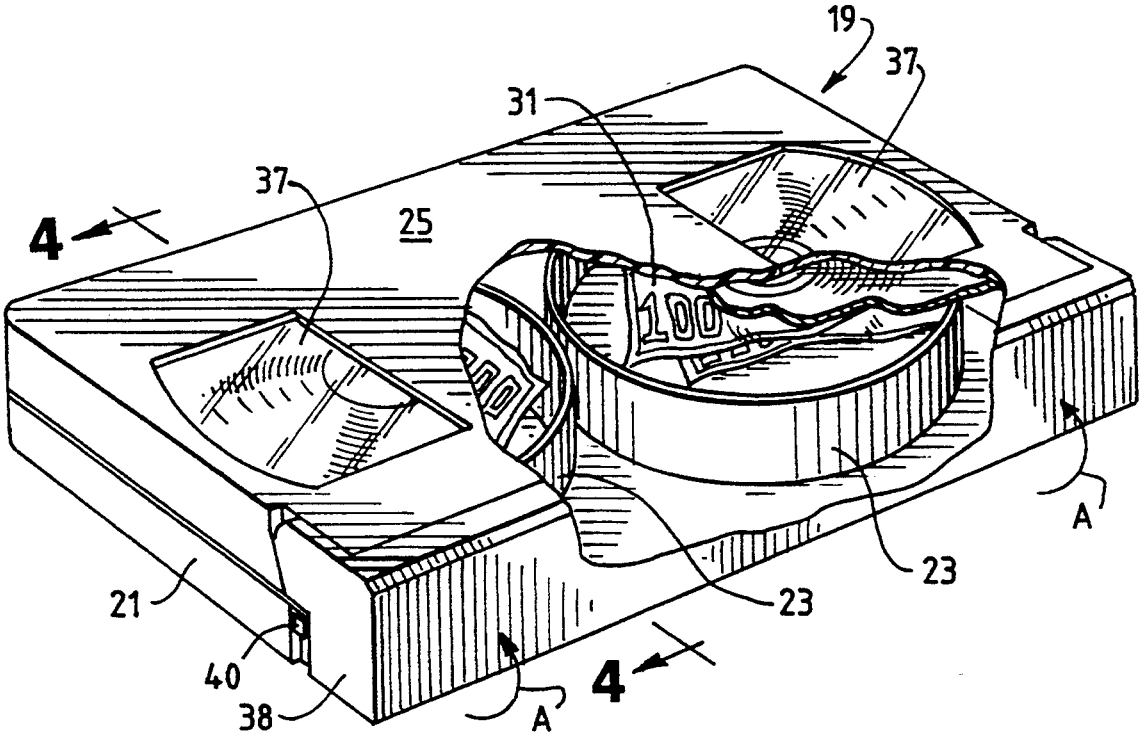
FIG. 1 is a perspective view of an embodiment of a repository in accordance with the present invention.
Figure 2:
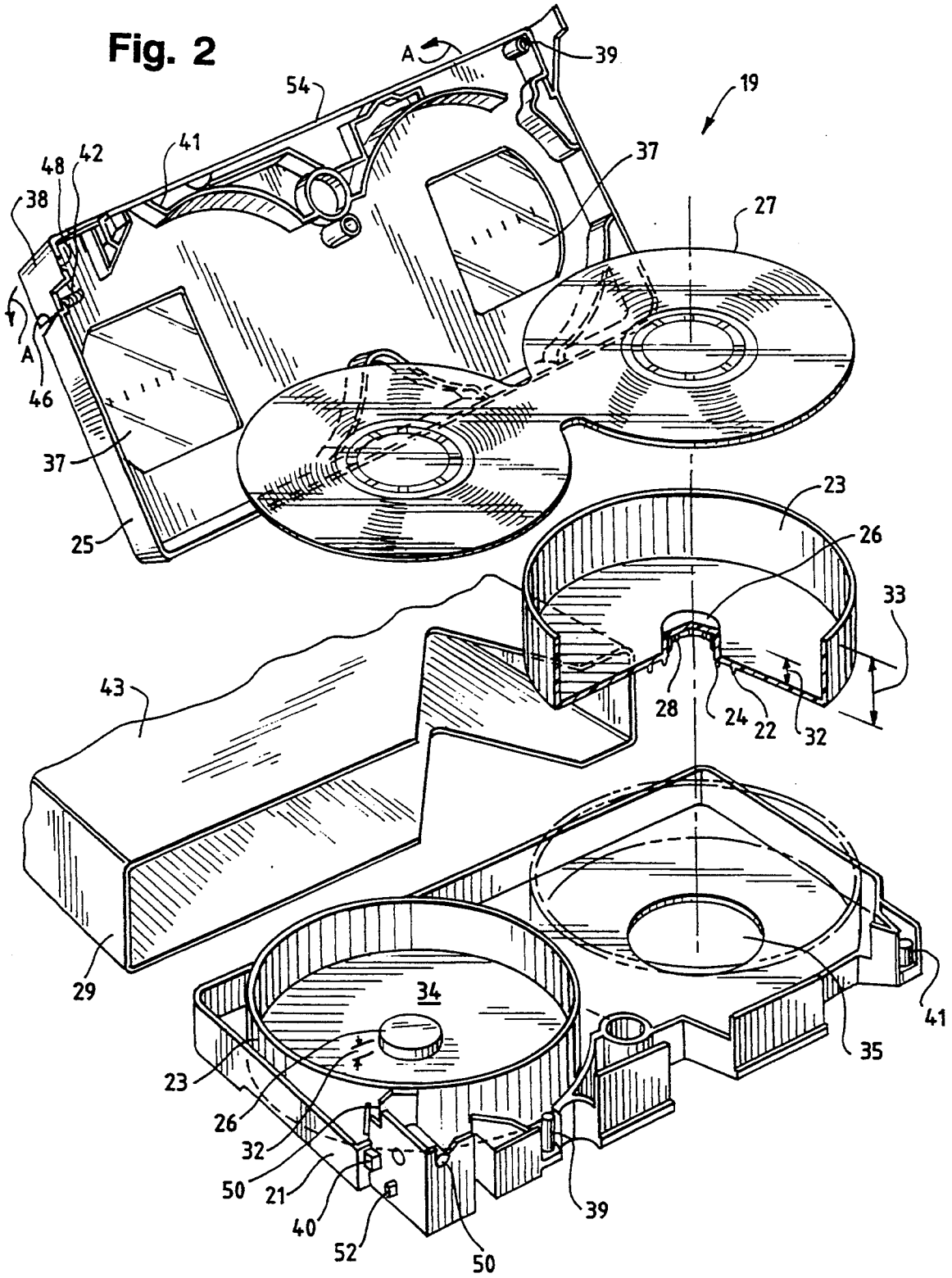
FIG. 2 is an exploded perspective view of the embodiment of FIG. 1 with the repository in the opened condition.

Referring now to the drawings, and particularly to FIGS. 1 and 2 thereof, there is shown a repository 19 simulating a videotape cassette and constructed in accordance with the present invention. Attached to a substantially rectangular base enclosure 21 are two cylindrical storage containers 23. The base enclosure and the containers are closed by a substantially rectangular cover 25 as shown in FIG. 1. Affixed inside of the cover 25 is a picture 27 simulating the inner mechanism of a VHS cassette. A sleeve 29 (FIG. 2) fits over the repository 19 to hold the base 21 and cover 25 together.

Figure 4:
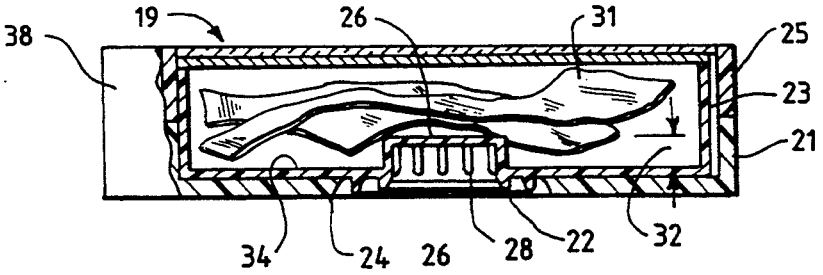
FIG. 4 is a sectional view taken along the line 4—4 in FIG. 1.

In operation, small articles 31 to be stored (FIGS. 1 and 4) are placed in the containers 23 which are attached to base enclosure 21. The cover 25 is then manually fitted over containers 23 and onto the base enclosure 21. When the cover is fitted over the base enclosure 21, the entire assembled structure then is slid manually into the sleeve 29. To retrieve stored objects, the cover 25 is manually removed from the base enclosure 21 with the aid of a flap 38 connected to the cover 25, and the articles are removed from the containers 23.

Figure 3:
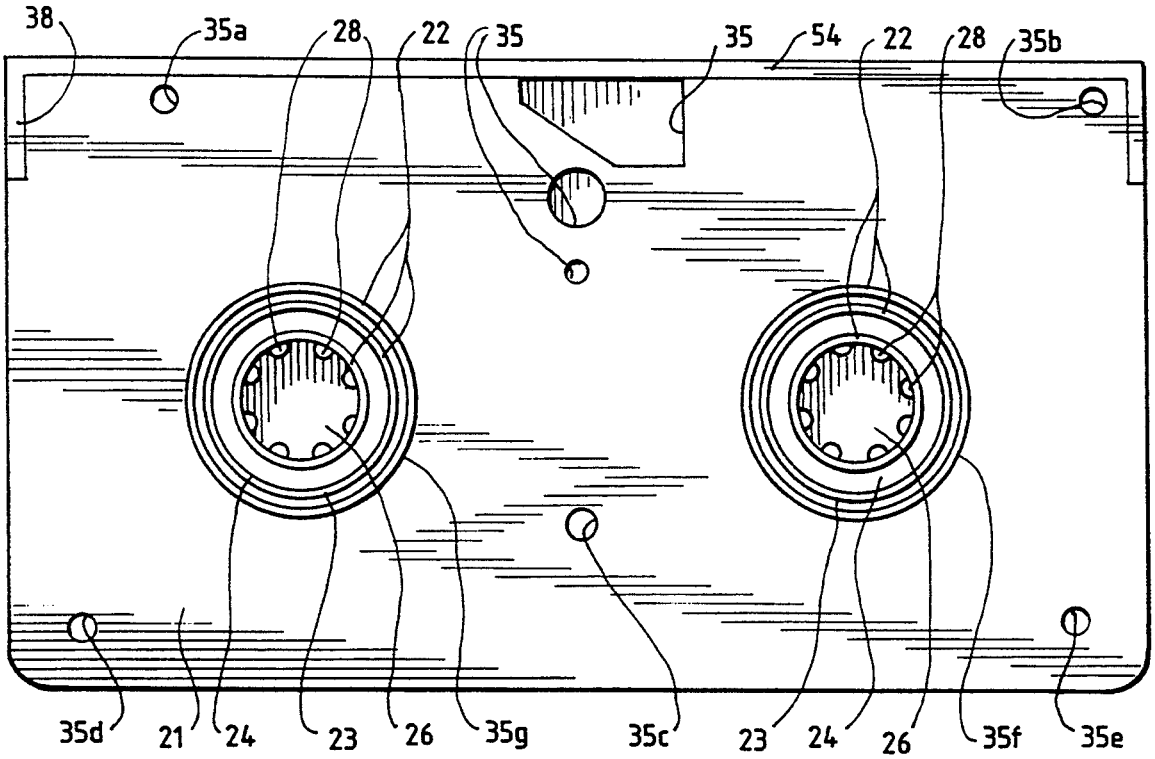
FIG. 3 is a bottom view of the embodiment of FIG. 1.

Referring now to FIG. 3, the base enclosure 21 has the same dimensions and configuration of apertures 35 as does the base of a standard VHS videotape cassette. The screws (not shown) normally mounted in apertures 35*a–e*, however, are removed in order to allow the cover 25 to be readily removable from the base enclosure 21 of the repository 19. A latch 40 (FIG. 2) is connected to a tongue 52 and is spring-mounted to the base enclosure 21 at hinge points 50 to engage the cover 25 as described subsequently.

The cylindrical containers 23 best shown in FIG. 2 are molded of plastic and have diameters substantially similar to the diameters of the tape spools normally contained in standard videotape cassettes. The cylindrical containers 23 include cylindrical sockets 26 extending from undersides 24 of the cylindrical containers (FIGS. 2 and 3). Spaced along the inner surfaces of the cylindrical sockets 26 are sprockets 28 best seen in FIG. 3. Annular ridges 22 formed in the undersides 24 surround the sockets 26. The sockets 21 with the sprockets 28 and the annular ridges 22 are aligned coaxially with the apertures 35*f* and 35*g* of the base enclosure 21. The apertures 35*f* and 35*g* are of sufficient dimension so that the sockets 26 with the sprockets 28 and the annular ridges 22 are visible from outside the cassette and thereby resemble the portions of standard videotape spools normally seen on the bottom of a standard videotape cassette.

The undersides 24 of the containers 23 are fixed to the base enclosure 21 with adhesive. The sockets 21 have depth 32 (FIGS. 2 and 3) sufficient to simulate corresponding sockets of a videotape spool, but not of such magnitude as to interfere with the storage of articles therein. Height 33 (FIG. 2) of the containers 23 is such that the cover 25 fits flush against them to seal substantially the containers 23 when the cover 25 is fitted to the base 25 as seen in FIG. 1.

As best seen in FIG. 2, the cover 25 has the same dimensions and configuration as the corresponding component of a standard VHS cassette. The cover includes two windows 37 made of clear plastic and a flap 38 pivotally mounted to one side of the cover 25 at hinge points 46 as in a standard VHS cassette. A spring 44 mounted on the inner surface of the cover 25 resists rotation of the flap 38 about the hinge points 46 in the direction of the arrows A. A groove 48 in the lower edge of the flap 38 is provided for connection to the base enclosure 21 as described subsequently. The picture 27 depicting the spools and wound tape inside a standard VHS cassette is affixed with a commercially available adhesive to the underside of the cover 25 so as to be visible through the windows 37 from outside the cassette.

To close the repository 19, the cover 25 is fitted over the base enclosure 21, so that locating prongs 39 (FIG. 2) engage in matching cavities 41. The spring-loaded tongue 52 on the base 25 engages the groove 48 on the inside of the flap 38 when the repository is fully closed as shown in FIG. 1, so as to prevent the flap 38 from pivoting in the direction of the arrows A.

To open the repository, the latch 40 is depressed manually inward which releases the tongue 52 from the groove 48 (FIG. 2). The flap 38 can then be grasped at its forward edge 54 so as to pivot the flap 38 in the direction of the arrows A and to permit separation of the cover 25 from the base 21.

The sleeve 29 shown in FIG. 2 has the same dimensions as a standard VHS cassette sleeve and includes markings at various locations such as 43 to simulate a commercially available videocassette product. The sleeve acts to hold the base enclosure 21 and cover 25 firmly together when it is slidably engaged around the repository 19, thereby avoiding inadvertent disassembly and preventing any stored articles 31 from escaping.

One of the advantages of the above described invention rests in the ease with which a useful repository for small articles can be created from a widely available, household manufacture such as a standard VHS cassette.

A further advantage to this invention resides in how accurately it simulates a commercially available VHS cassette tape. Since most households are likely to have many such VHS cassettes, the repository simulating a VHS cassette provided for in this invention can be easily mixed in with real VHS cassettes and thereby reduces the likelihood that a casual search by a thief will uncover the repository containing the stored articles.

Although the present invention has been described with reference to a preferred embodiment thereof illustrated in the accompanying drawings, various changes and modifications can be made by those skilled in the art without departing from the spirit and the scope of the present invention.

What is claimed is:

1. A repository for storing small articles, the repository comprising:

a base having an outside contour;

at least one container connected to the base located within the perimeter of the base; and a cover which seals the container and follows the outside contour of the base;

wherein the base and the cover are adapted to resemble a videotape cassette.

2. The repository of claim 1, further including a sleeve having an aperture of dimensions substantially similar to those of a cross-section of the repository, and into which the repository is removably insertable, thereby holding the cover in assembly with the base.

3. The repository of claim 2, in which the sleeve includes markings affixed to its outer surface which simulate commercially available videotape cassettes.

4. The repository of claim 1, in which at least one picture of the inside of a standard videotape cassette is affixed to the cover.

5. The repository of claim 1 in which the container has an underside portion resembling a portion of a videotape spool.

6. The repository of claim 5 in which the underside portion of the container includes ridges and sprockets circumferentially disposed around a cavity.

7. The repository of claim 5 in which the base has at least one aperture through which the underside portion of the container is visible.

8. A method for creating a repository for small articles from a VHS cassette, comprising the steps of removing fasteners from the VHS cassette; removing at least one tape spool from inside the VHS cassette; and mounting at least one container inside said cassette in place of said tape spool.

* * * * *